US007401975B2

(12) United States Patent
Hiranuma et al.

(10) Patent No.: US 7,401,975 B2
(45) Date of Patent: Jul. 22, 2008

(54) WATCH

(75) Inventors: Haruki Hiranuma, Chiba (JP); Nobukazu Omori, Chiba (JP)

(73) Assignee: Seiko Instruments Inc. (JP)

( * ) Notice: Subject to any disclaimer, the term of this patent is extended or adjusted under 35 U.S.C. 154(b) by 667 days.

(21) Appl. No.: 11/086,855

(22) Filed: Mar. 21, 2005

(65) Prior Publication Data

US 2005/0207286 A1 Sep. 22, 2005

(30) Foreign Application Priority Data

Mar. 22, 2004 (JP) ..... 2004-082213

(51) Int. Cl.
*G04B 37/00* (2006.01)

(52) U.S. Cl. ..... 368/319; 368/308; 368/309

(58) Field of Classification Search ..... 368/185, 368/190–199, 306, 308, 309, 319–321
See application file for complete search history.

(56) References Cited

U.S. PATENT DOCUMENTS 4,415,277 A * 11/1983 Ganter ..... 368/190
6,980,488 B2 * 12/2005 Schneider ..... 368/37
2005/0157594 A1 * 7/2005 Clot et al. ..... 368/319
2005/0249051 A1 * 11/2005 Cogoli et al. ..... 368/319

FOREIGN PATENT DOCUMENTS

JP 3213892 7/2000

* cited by examiner

*Primary Examiner*—Vit Miska
*Assistant Examiner*—Jeanne-Marguerite Goodwin
(74) *Attorney, Agent, or Firm*—Adams & Wilks

(57) ABSTRACT

To obtain a degree of freedom in a design of a circumference part of a timepiece armor assembly, and provide a watch whose degree of freedom in a size of a dial is high. A timepiece armor assembly is formed of an armor case of one-piece structure in which a case bottom wall and a case band part provided with a crown have been monolithically molded and of an armor cover which has a transparent member and an edge member supporting a circumference edge of the former member and has been mounted to the case band part. In the armor assembly, a timepiece movement which has a movement main body and a winding stem attached to this main body so as to be capable of being inserted into or detached from it and connected to the crown, and a dial are built, and a winding stem attachment/detachment mechanism which makes an insertion/detachment of the winding stem into/from the main body possible is provided. The winding stem attachment/detachment mechanism possesses an engagement body which has a stopper part engaged with or disengaged from a groove (engagement part) of the winding stem, and an engagement/disengagement operation body which causes the stopper part 34*a* to engage with or disengage from the groove 15*e* by follow-moving the engagement body. The engagement/disengagement operation body is provided in the case bottom wall so as to be capable of being operated from an outside of the armor case.

4 Claims, 7 Drawing Sheets

WATCH

BACKGROUND OF THE INVENTION

1. Field of the Invention

The present invention concerns a watch such as wristwatch, and especially relates to a watch possessing an interlock axle attachment/detachment mechanism for detaching a movement interlock axle, such as winding stem, capable of being inserted into or detached from a main body of a timepiece movement.

2. Description of the Prior Art

A timepiece armor assembly of the wristwatch is mainly classified into a type with a case back, which possesses a detachable case back and into which the timepiece movement is incorporated under a state that this case back has been detached, and a type with no case back, which possesses an armor case of one-piece structure, in which a case bottom wall and a case band part have been monolithically made, and into which the timepiece movement is incorporated from a front side of the armor case before an armor cover forming the timepiece armor assembly while being combined with this armor case is mounted to the case band part.

In the wristwatch of the type with the case back, by the fact that an outer diameter of the case back is larger than an inner diameter of the case band, there is a limitation in making a circumference part of the timepiece armor assembly into a design showing it thinly by making a circumference part back face side of the timepiece armor assembly into a taper-like form. On the other side of this, in a case where the winding stem capable of being inserted into or detached from the main body of the timepiece movement is detached, since a winding stem attachment/detachment mechanism can be operated by opening the case back, it is desirable in a point that a degree capable of freely setting a size of a dial with respect to the timepiece armor assembly is high.

In contrast to this, in the wristwatch of the type with no case back, from the fact that there is no case back, it is advantageous in a case where the circumference part of the timepiece armor assembly is made into the design showing it thinly by making the circumference part back face side of the timepiece armor assembly into the taper-like form.

Even in this kind of wristwatch of the type with no case back, it possesses the winding stem attachment/detachment mechanism for performing a disassembly. This winding stem attachment/detachment mechanism is provided in the armor cover mounted to the case band part of the armor case of one-piece structure (for example, refer to Patent Document 1).

That is, a setting lever of a setting lever axle is rotatably supported in a main plate of the timepiece movement, and one end part of a lever for setting lever is disposed in this setting lever while being overlapped. The other end part of the lever for setting lever is disposed in an annular interstice formed between a circumference edge of a dial covering the timepiece movement and an annular face opposed to a dial circumference edge of an edge member that the armor cover has. The other end part of the lever for setting lever is usually covered by the armor cover, but exposed so as to be operated by removing this armor cover.

And, by pressing down the other end part of the lever for setting lever, which has been exposed, by a pincette etc., it is possible to move the setting lever as the lever for setting lever is slanted. By the movement of the setting lever at this time, its stopper part is disengaged from an engagement part of the winding stem, and a retention of the winding stem is released.

Accordingly, under this state, it is possible to pull out the winding stem through a crown.

<Patent Document 1>

Japanese Patent No.3213892 Gazette

Like the Patent Document 1, in a constitution in which the winding stem attachment/detachment mechanism has been provided in the armor cover of the timepiece armor assembly, it is necessary that the other end part, of the lever for setting lever, operated so as to be pressed down by the pincette etc. protrudes from an edge of the dial. For this reason, unless an outer shape of the timepiece armor assembly is made large, a size of the dial is subjected to a limitation by the lever for setting lever. For this reason, it is difficult to develop the wristwatches of various modes whose sizes of the dial are different as merchandises, so that its improvement is demanded.

Objects of the present invention are to obtain a degree of freedom in a design of the circumference part of the timepiece armor assembly, and provide a watch whose degree of freedom in the size of the dial is high.

SUMMARY OF THE INVENTION

In order to solve the above problems, in the present invention, a timepiece armor assembly is formed from an armor case of one-piece structure in which a case bottom wall and a case band part provided with an outside operation body have been monolithically made and from an armor cover which has a transparent member and an edge member supporting a circumference edge of the transparent member and has been mounted to the case band part, a timepiece movement which has a movement main body and a movement interlock axle attached to this main body so as to be capable of being inserted into or detached from it and connected to the outside operation body, and a dial are built in the timepiece armor assembly, an interlock axle attachment/detachment mechanism which makes an insertion/detachment of the movement interlock axle into/from the movement main body possible is provided in the timepiece armor assembly, the interlock axle attachment/detachment mechanism possesses an engagement body which has a stopper part engaged with or disengaged from an engagement part provided in the movement interlock axle and an engagement/disengagement operation body which causes the stopper part to engage with or disengage from the engagement part by follow-moving the engagement body, and the engagement/disengagement operation body is provided in the case bottom wall so as to be capable of being operated from an outside of the armor case.

In this invention, the outside operation body is one represented by a crown for instance, and indicates a member which operates, for a time setting or a date setting and the like, the timepiece movement from an outside of a timepiece armor member. In this invention, the movement interlock axle is one represented by a winding stem for instance, and indicates a member which transmits, for the time setting and the like, an operation of the outside operation body to the movement main body of the timepiece movement. In this invention, the interlock axle attachment/detachment mechanism indicates a mechanism which can switch a retention state prohibiting an axial movement of the movement interlock axle such as the winding stem for instance and a release state releasing this retention, and which makes it possible, with this switching, that the movement interlock axle is inserted into or detached from the movement main body.

In order to solve the above problems, in the present invention, a timepiece armor assembly is formed from an armor case of one-piece structure in which a case bottom wall and a case band part provided with a crown have been monolithically made and from an armor cover which has a transparent member and an edge member supporting a circumference edge of the transparent member and has been mounted to the case band part, a timepiece movement which has a movement main body and a winding stem attached to this main body so as to be capable of being inserted into or detached from it and connected to the crown, and a dial are built in the timepiece armor assembly, a winding stem attachment/detachment mechanism which makes an insertion/detachment of the winding stem into/from the movement main body possible is provided in the timepiece armor assembly, the winding stem attachment/detachment mechanism possesses an engagement body which has a stopper part engaged with or disengaged from an engagement part provided in the winding stem and an engagement/disengagement operation body which causes the stopper part to engage with or disengage from the engagement part by follow-moving the engagement body, and the engagement/disengagement operation body is provided in the case bottom wall so as to be capable of being operated from an outside of the armor case.

In these inventions, since the armor case of the timepiece armor assembly is one-piece structure, there is no large limitation in providing a taper face in a circumference part back side of the armor case, so that it is suitable to make the circumference part of the timepiece armor assembly into a design in which it is thinly formed. And, the interlock axle attachment/detachment mechanism such as the winding stem attachment/detachment mechanism is provided not in the armor cover side but in the armor case side of one-piece structure, and provided in the case bottom wall that the armor case has such that an engagement/disengagement operation of this attachment/detachment mechanism can be operated from the outside. By this, the fact becomes null that the interlock axle attachment/detachment mechanism exerts a limitation on the size of the dial, so that it is possible to increase the degree of freedom in the size of the dial.

Further, in a preferred mode of the present invention, the engagement/disengagement operation body possesses a progression/regression member which has an angular tube part penetrating through an angular hole opened in the case bottom wall, which is provided so as to be capable of moving in a thickness direction of the case bottom wall, and which follow-moves the engagement/disengagement operation body by this movement, and an operation member which meshes with the progression/regression member, and which is provided in the case bottom wall so as to be capable of being rotation-operated from an outside of the case bottom wall. Incidentally, in this mode of the invention, as to the progression/regression member and the operation member, a female thread provided in an inner circumference of the progression/regression member may be meshed with a male thread provided in an outer circumference of the operation member or, conversely to this, a male thread provided in an outer circumference of the progression/regression member may be meshed with a female thread provided in an inner circumference of the operation member.

In this mode of the invention, by moving the progression/regression member, whose rotation is restrained by the angular hole, in a thickness direction of the case bottom wall by rotating the operation member from an outside of the timepiece armor assembly, it is possible to push and move the engagement/disengagement operation body by the progression/regression member. By removing the stopper part of the engagement/disengagement operation body from the engagement part of the movement interlock axle such as the winding stem by such a follow movement of the engagement/disengagement operation body with respect to the progression/regression member, a retention of the movement interlock axle by the interlock axle attachment/detachment mechanism can be released. By this, it is possible to remove the movement interlock axle from the movement main body through the outside operation body such as crown.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

One embodiment of the present invention is explained by referring to FIG. 1-FIG. 7.

Figure 1:
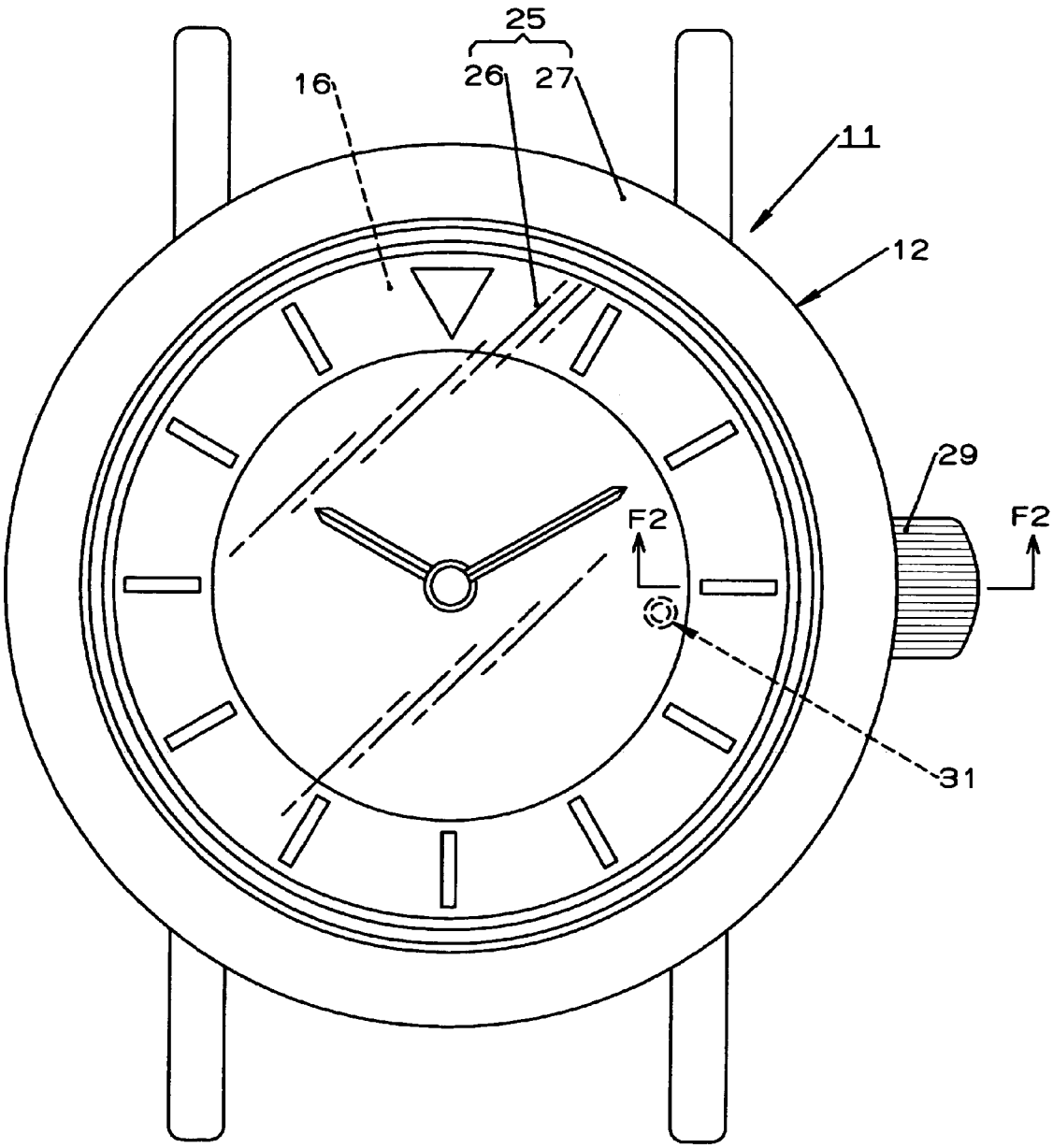
FIG. 1 is a plan view showing a wristwatch concerning one embodiment of the present invention.

In FIG. 1, a reference numeral 11 denotes a wristwatch as a watch. This wristwatch 11 possesses a timepiece armor assembly 12 and, in this timepiece armor assembly 12, there are built a timepiece movement 13 (refer to FIG. 2) and the like.

The timepiece movement 13 has a movement main body 14, and a movement interlock axle, e.g., winding stem 15, attached to this main body 14 so as to be capable of being inserted into or detached from it. The movement main body 14 may be any of one in which a small battery or a mainspring has been made a power source, or automatic winding one, or one corresponding to a digital timepiece digital-displaying a time and the like on a dial by a quartz oscillation module, or one in which one corresponding to the digital timepiece and one other than the former have been used in combination, or the like. A dial 16 is mounted to the movement main body 14 while covering its front face.

As shown in FIG. 2-FIG. 7, the winding stem 15 has a thread axle part 15*a* located outside the movement main body 14, a large diameter axle part 15*b* continuous to this thread axle part 15*a*, a small diameter axle part 15*c* continuous to this large diameter axle part 15*b*, and a flange-like protrusion part 15*d* formed in the small diameter axle part 15*c* while adjoining the large diameter axle part 15*b*. By this, between the large diameter axle part 15*b* and the protrusion part 15*d* of the winding stem 15, there is formed a groove 15*e* functioning as an engagement part.

Figure 2:
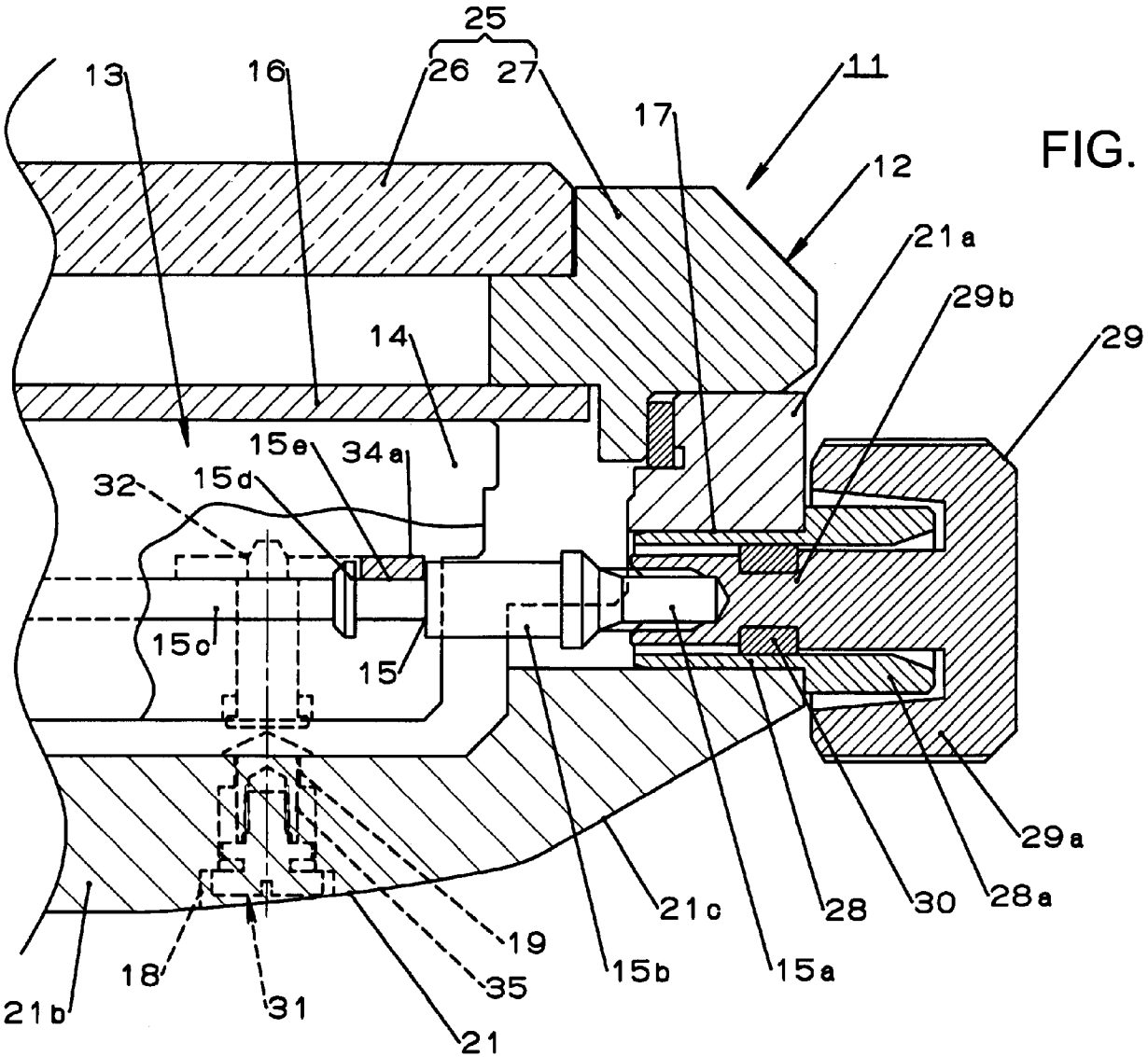
FIG. 2 is a sectional view showing along an F2-F2 line in FIG. 1.

As shown in FIG. 2, the timepiece armor assembly 12 possesses an armor case 21 and an armor cover 25 mounted to the former.

The armor case 21 has a concave one-piece structure with a case band part 21*a* and a case bottom wall 21*b* being monolithically made. It is accommodated through a front opening of this armor case 21. This armor case 21 may be obtained by monolithically molding a hard synthetic resin, or may be obtained by chipping a metal such as stainless or titanium.

A taper face 21*c* continuous in a circumferential direction is formed in a back face of the case band part 21*a*. By this taper face 21*c*, it is possible to show thinly a circumference part of the timepiece armor assembly 12. A pipe attachment hole 17 is provided in one part of the case band part 21*a* while penetrating it.

Figure 3:
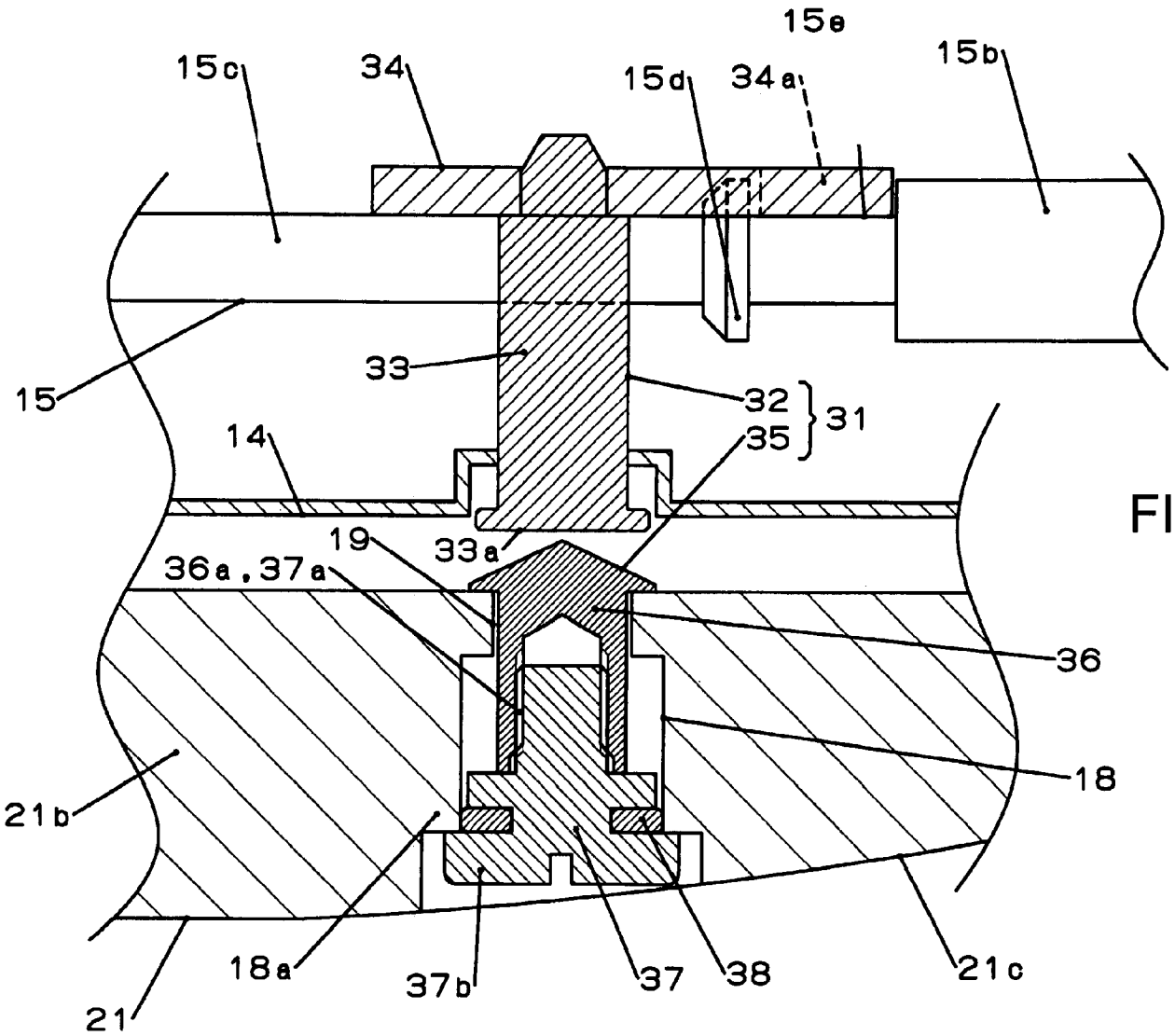
FIG. 3 is a sectional view showing a winding stem attachment/detachment mechanism of the timepiece of FIG. 1 under a state that a winding stem has been retained.
Figure 4:
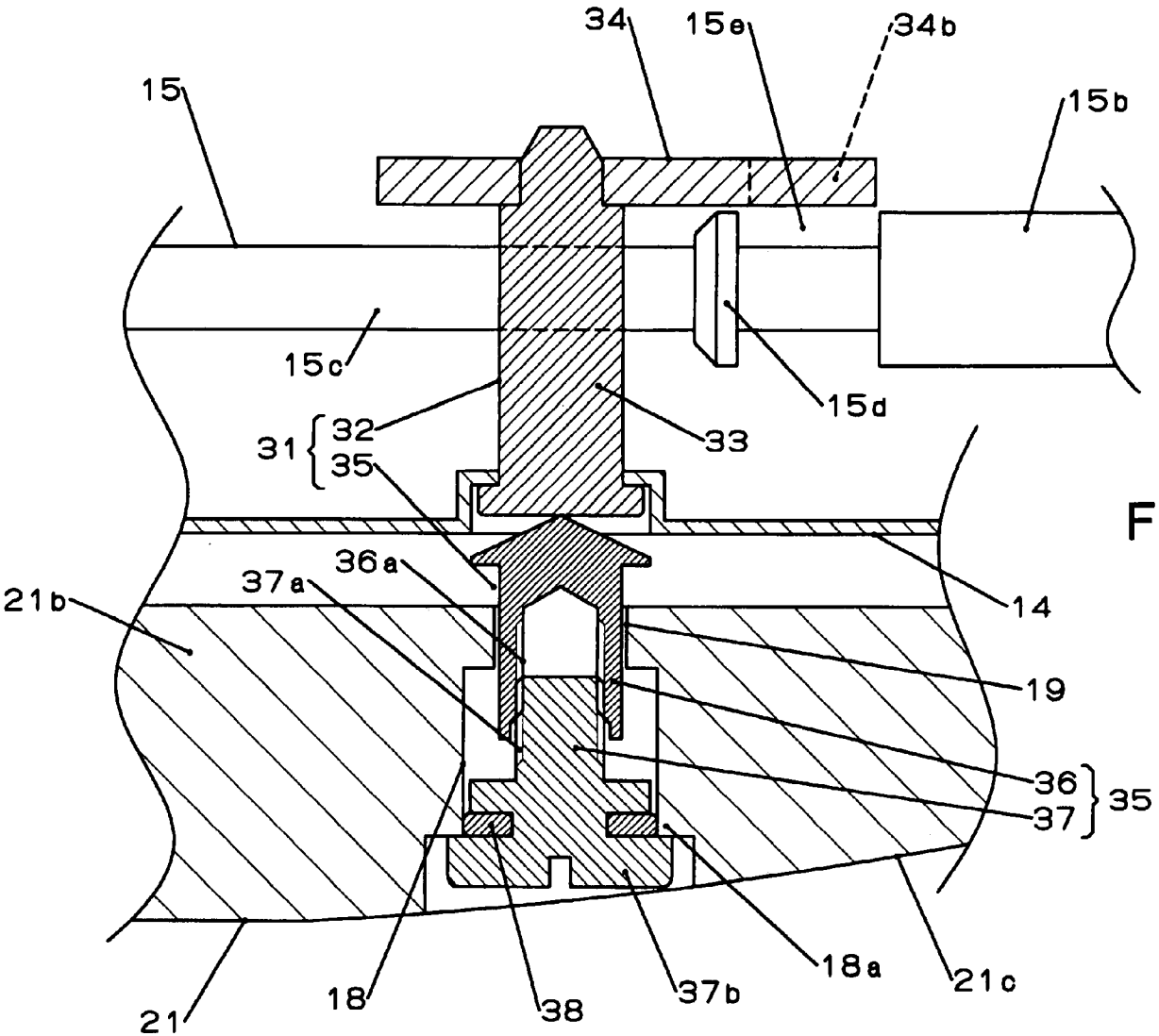
FIG. 4 is a sectional view showing the winding stem attachment/detachment mechanism of the timepiece of FIG. 1 under a state that a retention of the winding stem has been released.

An accommodation hole 18 and an angular hole 19 continuous to the former are perforated in a position, of the case bottom wall 21*b*, approaching the case band part 21*a*. As shown in FIG. 3 and FIG. 4, the accommodation hole 18 and the angular hole 19 penetrate through the case bottom wall 21*b* in a thickness direction. The accommodation hole 18 is a circular hole, and has a step 18*a*. The angular hole 19 is smaller than the accommodation hole 18, and formed in a polygonal shape, e.g., tetragon or hexagon. Incidentally, in a case where a battery is accommodated inside the armor case 21, a small lid for an exchange of this battery may be detachably provided in the case bottom wall 21*b*.

The armor cover 25 has a transparent member 26 consisting of a transparent glass and a transparent synthetic resin etc., and an annular edge member 27 supporting a circumference edge part of this transparent member 26. By mounting the edge member 27 to the case band part 21*a*, the timepiece armor assembly 12 is assembled with the transparent member 26 covering the dial 16.

As shown in FIG. 2, a winding stem pipe 28 having been inserted into the pipe attachment hole 17 from a case band outside is attached to the case band part 21*a*. The winding stem 28 made of a metal, e.g., made of stainless steel, has a case band outside protrusion part 28*a*. To this winding stem 28, there is attached a metal-made crown 29 functioning as an outside operation body operating the time piece movement 13 from outside. The crown 29 has a crown main part 29*a*, and a crown axle part 29*a* monolithically protruding from this center part to a back side.

The crown main part 29*a* covers the case band outside protrusion part 28*a* of the winding stem pipe 28, and the crown axle part 29*b* is inserted into the winding stem pipe 28. A waterproof ring 30 is mounted to an outer circumference face of the crown axle part 29*b*, and its outer circumference face closely contacts with an inner face of the winding stem pipe 28, and thereby a dustproofness/waterproofness between the winding stem pipe 28 and the crown axle part 29*b* is intended.

The thread axle part 15*a* of the above winding stem 15 is connected to the crown axle part 29*b* by being screwed in. For this reason, through the crown 29, the winding stem 15 is capable of being inserted into or detached from the movement main body 14 while passing through the winding stem pipe 28. This insertion/detachment of the winding stem 15 is performed when incorporating the timepiece movement 13 into the armor case 21 and when removing the timepiece movement 13 from the armor case 21. Further, through the crown 29, the winding stem 15 can select plural axial positions, for example, a 1st position shown in FIG. 5 and a 2nd position shown in FIG. 6 and FIGS. 7. The 1st position is a usual position in which a crown operation is not performed, and the 2nd position is a position in which a rotation operation of the crown 29 is possible for a time setting, a date setting and the like.

In the timepiece armor assembly 12, there is provided an interlock axle attachment/detachment mechanism, e.g., winding stem attachment/detachment mechanism 31, making it possible to insert the winding stem 15 that is the movement interlock axle into or detach it from the movement main body 14.

As shown in FIG. 3 and FIG. 4, the winding stem attachment/detachment mechanism 31 possesses an engagement body 32 engaged with or disengaged from the winding stem 15, and an engagement/disengagement operation body 35 follow-moving the engagement body 32 by being operated from an outside of the case bottom wall 21*b*.

Figure 5:
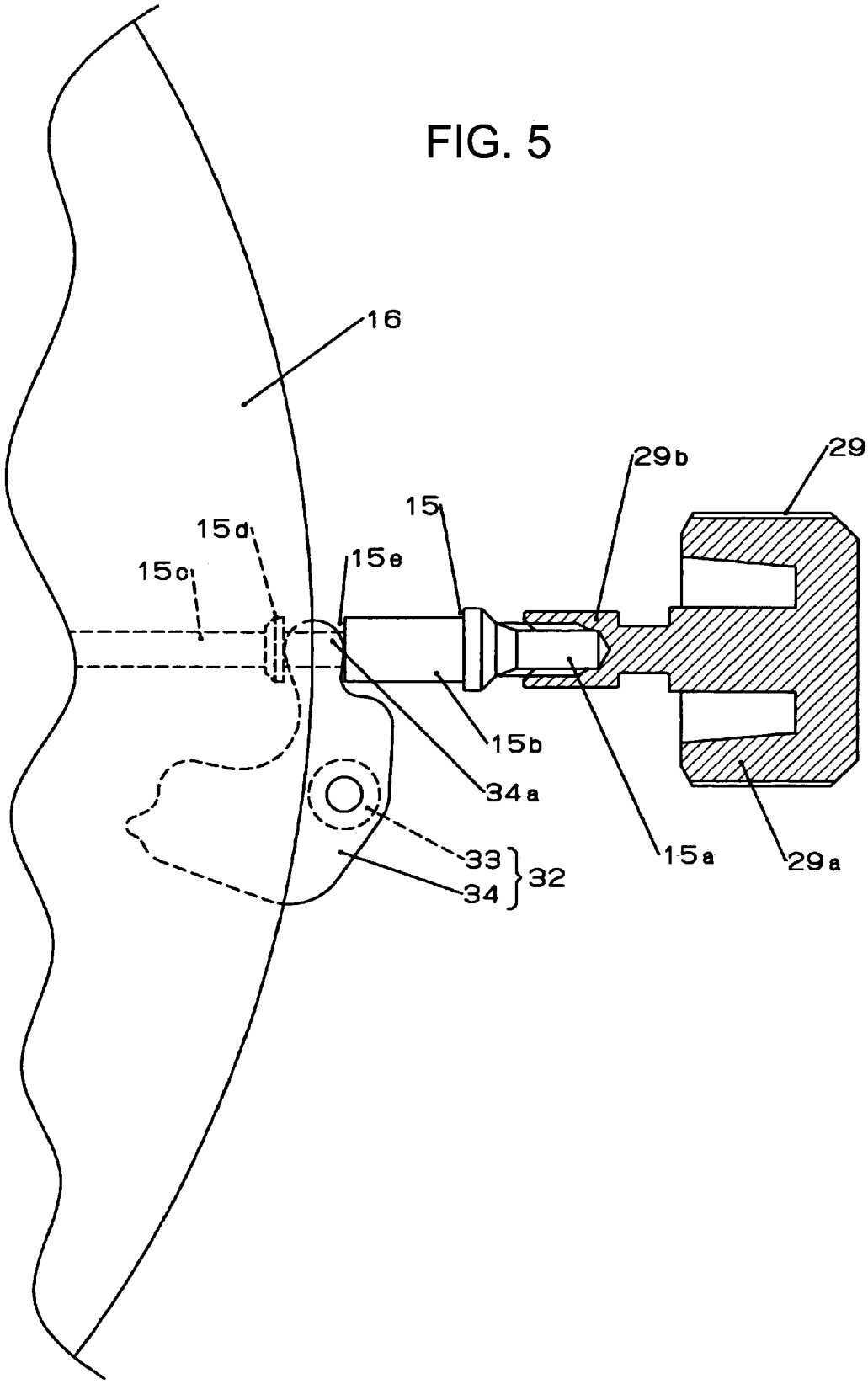
FIG. 5 is a view showing, under the state that the winding stem has been retained, a planar positional relation between a dial and a setting lever and the winding stem of the winding stem attachment/detachment mechanism of the time piece of FIG. 1.

The engagement body 32 is disposed in a circumference part of the movement main body 14, and comprises a movable axle 33 and an engagement member 34. The movable axle 33 is provided so as to be capable of moving along a thickness direction of the movement main body 14, and referred to also as setting lever pin. The engagement member 34 is referred to also as setting lever. This engagement member 34 is rotatably attached to the movable axle 33, but cannot move in an axial direction of the movable axle 33. As shown in FIG. 5-FIG. 7, in this engagement member 34, there is formed a stopper part 34*a*, which engages with or disengages from the groove 15*e* of the winding stem 15, in a position spaced from the movable axle 33.

The engagement/disengagement operation body 35 possesses a progression/regression member 36 follow-moving the engagement body 32, and an operation member 37 provided in the case bottom wall 21*b* so as to be capable of being rotation-operated from its outside.

The progression/regression member 36 has an angular tube part penetrating through the angular hole 19 of the case bottom wall 21*b*, and is provided so as to be capable of moving in a thickness direction of the case bottom wall 21*b*. A female thread 36*a* is formed in an inner circumference of this angular tube part of the progression/regression member 36. A tip part contiguous to the angular tube part of the progression/regression member 36 is wider than the angular hole 19, and gradually tapered from this portion. This tapered end is opposed to an end face 33*a* (end face in a side opposite to an end part by which the engagement member 34 has been supported) of the movable axle 33.

For the operation member 37, a screw member having a male thread 37*a* meshing with the female thread 36*a* can be suitably used. The operation member 37 is accommodated in its whole in the accommodation hole 18, and its screw head 37*b* butts against the step 18*a* of the accommodation hole 18, so that its axial movement in the angular hole 19 direction is prohibited. The screw head 37*b* faces on the outside of the case bottom wall 21*b* so as to be capable of being rotated from the outside of the case bottom wall 21*b*. Further, an annular waterproof packing 38 closely contacting with a small diameter hole part inner face of the accommodation hole 18 is attached to the operation member 37.

Like the above, the wristwatch 11 possesses the armor case 21 of one-piece structure in which the case band part 21*a* and the case bottom wall 21*b* have been monolithically molded, the timepiece movement 13 which has the movement main body 14 and the winding stem 15 as the movement interlock axle connected to this main body 14 so as to be capable of being inserted into or detached from it, and which is accommodated in the armor case 21, the crown 29 as the outside operation body, which is disposed in the case band part 21*a* and connected to the winding stem 15, the dial 16 built in the armor case 21 while covering the timepiece movement 13, the armor cover 25 having the transparent member 26 covering this dial 16 and the edge member 27 mounted to the case band part 21*a* while supporting the circumference edge of this transparent member 26, and the winding stem attachment/detachment mechanism 31 as the interlock axle attachment/detachment mechanism, which has the engagement body 32, in which there has been formed the stopper part 34*a* engaged with or disengaged from the groove 15*e* as the engagement part provided in the winding stem 15, and has the engagement/disengagement operation body 35 causing the stopper part 34*a* to engage with or disengage from the groove 15*e*, and in which this engagement/disengagement operation body 35 is provided in the case bottom wall 21*b* so as to be capable of being operated from the outside of the armor case 21.

A mutual relation between the winding stem attachment/detachment mechanism 31 and the winding stem 15 under a usual state that this wristwatch 11 is being carried is shown in FIG. 3 and FIG. 5. Under this state, since the engagement/disengagement operation body 35 is separated from the engagement body 32 and the engagement body 32 exists in a position dropped by its own weight, its stopper part 34*a* fits with the groove 15*e* of the winding stem 15 and is being caught. In other words, the winging stem 15 is retained so as not to move in its axial direction. Incidentally, under this state, the engagement member 34 is position-regulated so as not to be carelessly rotated, by a not-shown click means provided between the engagement member 34 and the movement main body 14. Further, under this state, since the tip part of the engagement/disengagement operation body 35 is caught by a hole edge of the angular hole 19 in an inside of the armor case 21, there is no fact that the engagement/disengagement operation body 35 drops from the accommodation hole 18.

Figure 6A:
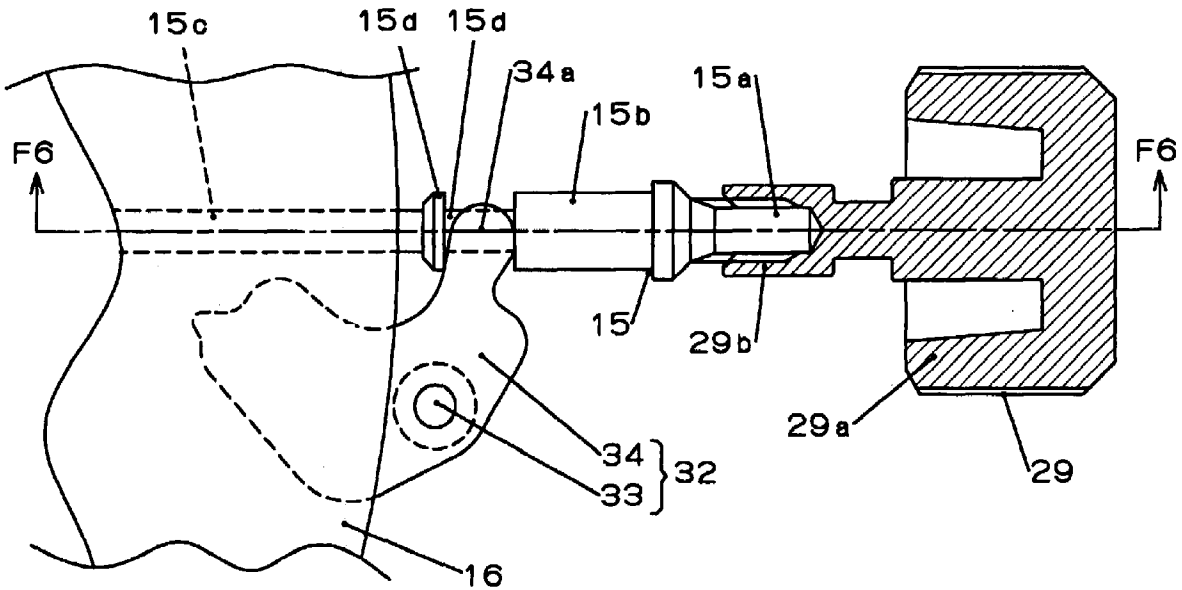
FIG. 6A is a view showing, under a state that a crown is operated, the planar positional relation between the dial and the setting lever and the winding stem of the winding stem attachment/detachment mechanism of the timepiece of FIG. 1, and FIG. 6B a sectional view showing along an F6-F6 line in FIG. 6A.
Figure 6B:
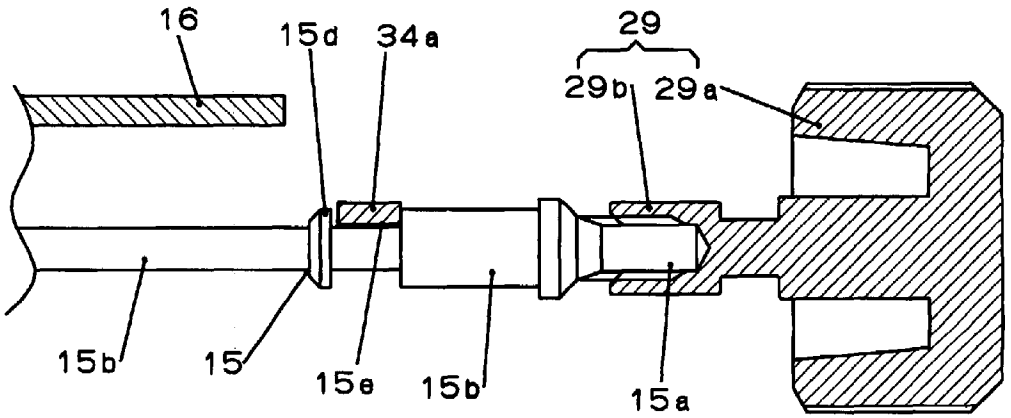

In a case where performing a crown operation such as time setting, first it is made into a state shown in FIGS. 6A-6B by pulling out the winding stem 15 to its 1st step through the crown 29 while resisting against the above click means. At this time, although the engagement member 34 follows in compliance with an axial displacement of the winding stem 15 and rotates with the movable axle 33 being made a center, the stopper part 34*a* still fit with the groove 15*e* and is caught intact. Next, under this state, the crown 29 is rotation-operated. By this, the time setting and the like can be performed by giving the rotation of the crown 29 to the movement main body 14 through the winding stem 15.

Figure 7A:
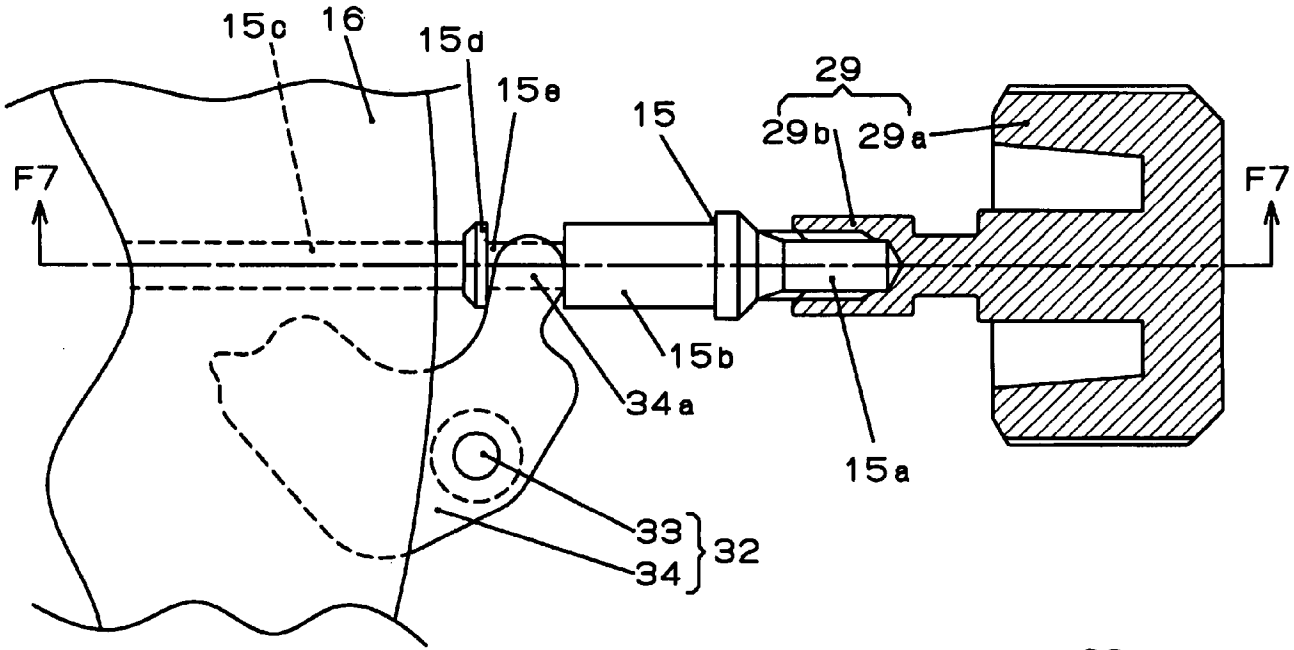
FIG. 7A is a view showing, under the state that the retention of the winding stem has been released, the planar positional relation between the dial and the setting lever and the winding stem of the winding stem attachment/detachment mechanism of the timepiece of FIG. 1, and FIG. 7B a sectional view showing along an F7-F7 line in FIG. 7A.
Figure 7B:
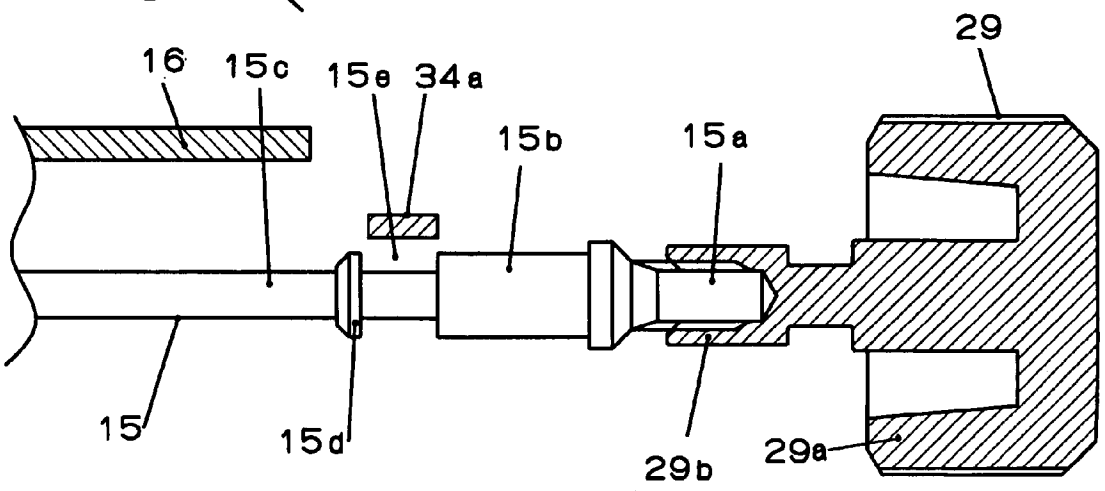

Further, in a case of pulling out the winding stem 15 from the movement main body 14, the operation member 37 of the engagement/disengagement operation body 35 is rotated in a screw-in direction from the outside of the armor case 21. With this, the progression/regression member 36 whose rotation is prevented by the angular hole 19 is moved in the thickness direction of the case bottom wall 21*b* so as to increase a protrusion amount to an inside of the armor case 21, on the basis of a change in a meshing between the female thread 36*a* of the progression/regression member and the male thread 37*a* of the operation member 37. By this, since the progression/regression member 36 presses and moves the movable axle 33 in the axial direction, the whole engagement body 32 is moved, so that the stopper part 34*a* is removed from the groove 15*e* of the winding stem 15 as shown in FIG. 4 and FIGS. 7A-7B. That is, a restriction of the winding stem 15 with respect to the axial direction is released. Accordingly, by pulling the crown 29 under this state, it is possible to separate the winding stem 15 from the movement main body 14 to thereby pull out it while passing through the winding stem pipe 28. Incidentally, such a detachment of the winding stem 15 can be performed even if it is a complete state before the armor cover 25 is removed, and also under a state that the armor cover 25 has been removed.

Like the above, since the engagement/disengagement operation body 35 of the winding stem attachment/detachment mechanism 31 has been provided not in the armor cover 25 side but in the case bottom wall 21*b* that the armor case 21 of one-piece structure has so as to be capable of being operated from the outside, it is possible to provide the winding stem attachment/detachment mechanism 31 and the dial 16 irrelevantly each other. That is, the fact becomes null that the operation member 37 of the winding stem attachment/detachment mechanism 31 and the like exert the limitation on the size of the dial 16. By this, as a degree of freedom in the size of the dial 16 is increased, the wristwatch 11 of various modes different in the size of the dial 16 can be made easy to be provided.

Moreover, since the armor case 21 is one-piece structure, there is no large limitation in providing the taper face 21*c* in the circumference part back side of this armor case 21. By this, it is possible to constitute the wristwatch 11 having been made a design in which the circumference part of the timepiece armor assembly 12 is formed thinly.

Accordingly, it can be made the wristwatch 11 in which, in the timepiece armor assembly 12 of a certain limited size, the dial is relatively large and the circumference part of the timepiece armor assembly 12 is thin, and therefore which shows thinly in appearance.

Further, since the female tread 36*a* provided in the inner circumference of the progression/regression member 36 and the operation member 37 have been meshed with the male thread 37*a* provided in an outer circumference of the operation member 37, there is no fact that the thread part provided in the progression/regression member 36 comes to the angular hole 19 with the axial direction of this progression/regression member 36. Accordingly, it is desirable in a point that the progression/regression member 36 can be smoothly moved while interlocking with the operation of the operation member 37.

The present invention can be applied also to a watch such as pocket watch.

According to the present invention, it is possible to provide a watch whose degree of freedom in the size of the dial is high because the size of the dial is adapted so as not to be subjected to the limitation, by the interlock axle attachment/detachment mechanism which makes the insertion/detachment of the movement interlock axle such as the winding stem possible while making the best use of the degree of freedom in the design of the circumference part of the timepiece armor assembly, which is a characteristic of the timepiece armor assembly having the armor case of one-piece structure.

What is claimed is:

1. A watch comprising:

a timepiece armor assembly comprising an armor case of one-piece structure in which a case bottom wall and a case band part provided with an outside operation body have been monolithically made and an armor cover which has a transparent member and an edge member supporting a circumference edge of the transparent member and has been mounted to the case band part, a timepiece movement which has a movement main body and a movement interlock axle attached to this main body so as to be capable of being inserted into or detached from it and connected to the outside operation body, and a dial are built in the timepiece armor assembly, an interlock axle attachment/detachment mechanism which makes an insertion/detachment of the movement interlock axle into/from the movement main body possible is provided in the timepiece armor assembly, wherein the interlock axle attachment/detachment mechanism possesses an engagement body which has a stopper part engaged with or disengaged from an engagement part provided in the movement interlock axle and an engagement/disengagement operation body which causes the stopper part to engage with or disengage from the engagement part by follow-moving the engagement body, and wherein the engagement/disengagement operation body is provided in the case bottom wall so as to be capable of being operated from an outside of the armor case.

2. A watch comprising:

a timepiece armor assembly comprising an armor case of one-piece structure in which a case bottom wall and a case band part provided with a crown have been monolithically made and an armor cover which has a transparent member and an edge member supporting a circumference edge of the transparent member and has been mounted to the case band part, a timepiece movement which has a movement main body and a winding stem attached to this main body so as to be capable of being inserted into or detached from it and connected to the crown, and a dial are built in the timepiece armor assembly, a winding stem attachment/detachment mechanism which makes an insertion/detachment of the winding stem into/from the movement main body possible is provided in the timepiece armor assembly, wherein the winding stem attachment/detachment mechanism possesses an engagement body which has a stopper part engaged with or disengaged from an engagement part provided in the winding stem and an engagement/disengagement operation body which causes the stopper part to engage with or disengage from the engagement part by follow-moving the engagement body, and wherein the engagement/disengagement operation body is provided in the case bottom wall so as to be capable of being operated from an outside of the armor case.

3. A watch according to claim 1, wherein the engagement/disengagement operation body possesses:

a progression/regression member which has an angular tube part penetrating through an angular hole opened in the case bottom wall, which is provided so as to be capable of moving in a thickness direction of the case bottom wall, and which follow-moves the engagement/disengagement operation body by this movement, and an operation member which meshes with the progression/regression member, and which is provided in the case bottom wall so as to be capable of being rotation-operated from an outside of the case bottom wall.

4. A watch according to claim 2, wherein the engagement/disengagement operation body possesses:

a progression/regression member which has an angular tube part penetrating through an angular hole opened in the case bottom wall, which is provided so as to be capable of moving in a thickness direction of the case bottom wall, and which follow-moves the engagement/disengagement operation body by this movement, and an operation member which meshes with the progression/regression member, and which is provided in the case bottom wall so as to be capable of being rotation-operated from an outside of the case bottom wall.

* * * * *